US011802425B2

(12) United States Patent
Nam et al.

(10) Patent No.: US 11,802,425 B2
(45) Date of Patent: Oct. 31, 2023

(54) ELECTRIC DOOR LATCH APPARATUS FOR VEHICLE

(71) Applicants: Hyundai Motor Company, Seoul (KR); Kia Motors Corporation, Seoul (KR)

(72) Inventors: Jinwoo Nam, Seoul (KR); Jungho Han, Seoul (KR); Kyoung Taek Kwak, Yongin-si (KR); Jungmin Eom, Incheon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 429 days.

(21) Appl. No.: 16/995,097

(22) Filed: Aug. 17, 2020

(65) Prior Publication Data

US 2021/0214975 A1 Jul. 15, 2021

(30) Foreign Application Priority Data

Jan. 10, 2020 (KR) ..... 10-2020-0003755

(51) Int. Cl.
*E05B 81/16* (2014.01)
*E05B 81/06* (2014.01)
(Continued)

(52) U.S. Cl.
CPC ..... *E05B 81/16* (2013.01); *E05B 77/26* (2013.01); *E05B 81/06* (2013.01); *E05B 81/34* (2013.01); *E05B 81/90* (2013.01)

(58) Field of Classification Search
CPC ..... E05B 81/16; E05B 81/06; E05B 81/34; E05B 81/90; E05B 77/26
(Continued)

(56) References Cited

U.S. PATENT DOCUMENTS 10,392,838 B2 * 8/2019 Tomaszewski ..... E05B 81/90
2005/0145740 A1 * 7/2005 Rathmann ..... E05B 81/14 242/382

(Continued)

FOREIGN PATENT DOCUMENTS

CN 104271859 A 1/2015
CN 104285022 A 1/2015

(Continued)

OTHER PUBLICATIONS

National Intellectual Property Administration, PRC; Office Action dated Aug. 3, 2023 in Chinese Patent Application No. 202010972139.8; 17 pages.

*Primary Examiner* — Kristina R Fulton
*Assistant Examiner* — James E. Ignaczewski
(74) *Attorney, Agent, or Firm* — Slater Matsil, LLP

(57) ABSTRACT

An electric door latch apparatus includes a catching part for catching a striker, a door locking and unlocking part for applying a torque to the catching part through a main motor, an electric emergency door unlocking part configured to enable the door to be released from the vehicle body through a sub-motor, an inside emergency operation lever connected to an inside handle installed in the door, rotatable by an operational force of the inside handle, and configured to apply a torque to the catching part, an outside emergency operation lever connected to an outside handle installed in the door, rotatable by an operational force of the outside handle, and configured to apply a torque to the catching part, and a manual emergency door unlocking part connected to the inside emergency operation lever and configured to apply a torque to the catching part.

20 Claims, 14 Drawing Sheets

(51) Int. Cl.
*E05B 81/34* (2014.01)
*E05B 81/90* (2014.01)
*E05B 77/26* (2014.01)

(58) Field of Classification Search
USPC ..... 292/201
See application file for complete search history.

(56) References Cited

U.S. PATENT DOCUMENTS

2009/0025999 A1* 1/2009 Ishiguro ..... E05B 77/265 180/287
2009/0241617 A1* 10/2009 Takahashi ..... E05B 77/26 292/216
2009/0322105 A1 12/2009 Lee et al.
2011/0214460 A1* 9/2011 Byun ..... E05C 9/10 70/91
2013/0161961 A1 6/2013 Burciaga et al.
2015/0021934 A1 1/2015 Barmscheidt et al.
2015/0084352 A1 3/2015 Barmscheidt
2015/0308163 A1* 10/2015 Tomaszewski ..... E05B 77/32 292/196
2017/0314298 A1* 11/2017 Tomaszewski ..... E05B 81/06
2021/0164274 A1* 6/2021 Tanino ..... E05B 81/34

FOREIGN PATENT DOCUMENTS

CN 105507694 A 4/2016
CN 110273598 A 4/2016
DE 102014114738 A1 * 6/2015 ..... E05B 77/26
DE 102014016787 A1 * 5/2016 ..... E05B 63/0065
JP 2010013919 A 1/2010
JP 4503051 B2 7/2010
JP 2012007341 A 1/2012
KR 110273598 A 6/2009
KR 101513000 B1 4/2015

* cited by examiner

ELECTRIC DOOR LATCH APPARATUS FOR VEHICLE

CROSS-REFERENCE TO RELATED APPLICATIONS

This application claims the benefit of Korean Patent Application No. 10-2020-0003755, filed in the Korean Intellectual Property Office on Jan. 10, 2020, which application is hereby incorporated herein by reference.

TECHNICAL FIELD

The present invention relates to an electric door latch apparatus for a vehicle.

BACKGROUND

In general, a door latch apparatus is provided on a vehicle door. The opening and closing of the door and the lock/unlock of the door are made by operating the inside handle and safety knob positioned inside the door, by operating an outside handle positioned outside the door, or by operating a key.

Additionally, in the case of a vehicle with a personal identification card (PIC) system called a smart key, locking of the door may be released by completing a personal authentication process to lock the door even if the driver has only a smart key (a smart card or a smart key fob, etc.).

Recently, an electric door latch (E-door latch) apparatus driven by electrical force is applied instead of a conventional mechanical door latch apparatus operated by a mechanical structure.

Since the electric door latch apparatus uses the electric driving torque of the motor, it has an advantage that the feeling of operation is more luxurious than that of the mechanical door latch apparatus.

In addition, when the electric door latch apparatus is applied, as in the case where the conventional mechanical door latch apparatus is applied, when authentication through a smart key is completed, the driver may immediately pull the outside handle to open the door.

However, the electric door latch apparatus is operated only when power is supplied. Therefore, when the battery of the vehicle is discharged or there is a side crash, or when a power cable from the battery to the door latch apparatus is disconnected due to deformation of the door because of a lateral crash, operation of the door lock release is impossible, and eventually the door cannot be opened even if the outside handle is operated.

If the door cannot be opened, it is impossible to open a hood to replace the battery of the vehicle or to connect the battery to a battery of another vehicle for a restart. Particularly, since the door cannot be opened in an emergency such as an accident, follow-up is impossible.

In order to prevent such an inoperable situation, a separate additional battery may be installed in the vehicle. However, this may increase the weight and cost of the vehicle, and as a natural discharge time of the battery due to the power of the vehicle, it may occur that the electric door latch apparatus cannot be supplied with power by the additional battery.

Meanwhile, the vehicle door is equipped with a separate child-lock device that is electrically operated to prevent the occupant, such as a child in the rear seat, from inadvertently manipulating the inside handle to release the locking of the door. Since the child-lock device is typically realized using a motor or link separate from the electric door latch apparatus, it increases the number of parts and weight and cost of the vehicle.

In addition, the door is installed with a so-called deadlock device mainly for the purpose of preventing theft of the vehicle, where the door locked to the vehicle body cannot be forcibly opened from an inside or outside the vehicle if a key or a remote controller is not used. Since the deadlock device is also realized using a motor or link separate from the electric door latch apparatus, it increases the number of parts and weight and cost of the vehicle.

Accordingly, it is necessary to research and develop a more compact electric door latch apparatus by integrating child-lock function and deadlock function to the above-described function of the electric door latch apparatus, in addition to a structure to release the door locked state through an appropriate door locking release scheme even if the operation of the motor is unavailable due to a vehicle collision accident or battery discharge.

The above information disclosed in this Background section is only for enhancement of understanding of the background of the invention, and therefore it may contain information that does not form the prior art that is already known to a person of ordinary skill in the art.

SUMMARY

An exemplary embodiment of the present invention provides an electric door latch apparatus for a compact and smart vehicle door by integrating various functions, such as allowing an emergency door release function, a child-lock function, and a deadlock function, into a single scheme.

An exemplary electric door latch apparatus includes a catching part, a door locking and unlocking part, an electric emergency door unlocking part, an inside emergency operation lever, an outside emergency operation lever, and a manual emergency door unlocking part. The catching part is mounted on a first base plate and configured to catch a striker mounted on a vehicle body to lock the door to the vehicle body or to be released from the striker to unlock the door from the vehicle body. The door locking and unlocking part may apply a torque to the catching part through a main motor mounted on a second base plate such that the catching part is locked and unlocked to the striker. The electric emergency door unlocking part may be configured to enable the door to be released from the vehicle body through a sub-motor mounted on the second base plate when the main motor is inoperable. The inside emergency operation lever may be connected to an inside handle installed in the door, rotatable by an operational force of the inside handle, and configured to apply a torque to the catching part through the electric emergency door unlocking part. The outside emergency operation lever may be connected to an outside handle installed in the door, rotatable by an operational force of the outside handle, and configured to apply a torque to the catching part through the electric emergency door unlocking part. The manual emergency door unlocking part is mounted on the second base plate, connected to the inside emergency operation lever, and configured to apply a torque to the catching part through the electric emergency door unlocking part by a torque of the inside emergency operation lever.

The catching part may include a catch rotatably mounted on the first base plate, and be formed with a locking indentation configured to catch or release the striker, a pawl rotatably mounted on the first base plate while contacting the catch, and configured to stop rotation of the catch or to enable the catch to freely rotate, and a pawl release lever disposed between the pawl and the first base plate and rotatable integrally with the pawl.

The door locking and unlocking part may include a main motor mounted on the second base plate and include a main drive gear formed on a rotation shaft rotatable in both directions, a main driven gear engaged with the main drive gear, and a main operation lever engaged with the main driven gear and configured to rotate the pawl release lever by being rotated by a torque from the main driven gear.

The pawl release lever may be formed with two seated protrusions. The main operation lever may be formed with a pressurizing protrusion to be placed on the seated protrusions to press and rotate the pawl release lever.

The electric emergency door unlocking part may include a sub-motor mounted on the second base plate at a position adjacent to the main motor, and include a sub-drive gear formed on a rotation shaft rotatable in both directions, a sub-driven gear engaged with the sub-drive gear, a master lock link rotatably installed on the first base plate, coupled with the outside emergency operation lever, and formed with a hook, and a pressurizing spring pressing the master lock link to rotate in a predetermined direction.

The inside emergency operation lever may be rotatably installed on the second base plate to be rotatable by an operation of the inside handle, and formed with a pressurizing flange. The master lock link may include a rotation inducing flange pressed by the pressurizing flange to rotate the master lock link.

The outside emergency operation lever is rotatably installed on the first base plate to be rotatable by an operation of the outside handle, and is formed with a first long hole into which a pin shaft of the master lock link is inserted.

An exemplary electric door latch apparatus may further include a key lever formed with a position regulating recess and a catching end. The position regulating recess may be coupled with a rotation protrusion integrally formed on the sub-driven gear so as to regulate a position of the key lever in an up and down direction according to a rotation operation of the sub-driven gear. The catching end may be connected to a key nut into which a vehicle key may be inserted and rotated.

The key nut may include a first operation protrusion 61 and a second operation protrusion 62 that are circumferential apart from each other to form a movable recess into which the catching end is movably inserted.

The key lever may include a second long hole formed at a first central portion of the key lever. A mounting protrusion integrally formed on the first base plate may be inserted into the second long hole such that the key lever may be supported by the mounting protrusion.

The master lock link may be formed with a stopping protrusion at a position adjacent to the hook. A rotation angle of the master lock link may be regulated through the stopping protrusion and the key lever.

A first end of the manual emergency door unlocking part may be connected to a pushing flange of the inside emergency operation lever. A central portion of the manual emergency door unlocking part may be connected to the key lever such that the key lever is operated by an operation of the inside emergency operation lever.

The manual emergency door unlocking part may include a first connection protrusion, a second connection protrusion, and a compression spring. The first connection protrusion may protrude correspondingly to the pushing flange, at a first end portion corresponding to the inside emergency operation lever, and may be configured to rotate by the operation of the inside emergency operation lever. The second connection protrusion may be positioned and protrude on an upper portion of a catching step formed on a central portion of the key lever. The compression spring may be disposed adjacent to the second connection protrusion, and configured to move the key lever according to an operation of the inside emergency operation lever.

An exemplary electric door latch apparatus may further include a controller, wherein, when the main motor is inoperable, the controller applies an operation signal to the sub-motor to operate the sub-motor.

The inside handle of a rear set is operated in order to open the door while a child-lock switch is turned on, and the controller operates the sub-motor in a reverse direction to maintain the door as locked to the vehicle body.

The inside handle is operated in order to open the door while a parking switch is turned on, and the controller operates the sub-motor in a reverse direction to maintain the door as locked to the vehicle body.

According to an electric door latch apparatus for a vehicle according to an exemplary embodiment, since the door may be locked and unlocked stably on the vehicle body using the main motor, the user may conveniently use the vehicle door.

In addition, according to an electric door latch apparatus for a vehicle according to an exemplary embodiment, a sub-motor is employed such that, even if the main motor is inoperable, for example, due to discharge of the battery or a vehicle collision accident, the door locked to the vehicle body may be released through the sub-motor by operating the inside handle or the outside handle, and therefore, the safety of the vehicle door may be secured.

In addition, according to an electric door latch apparatus for a vehicle according to an exemplary embodiment, when the main motor and sub-motor are simultaneously inoperable, the door locked to the vehicle body may be released using the vehicle key, and therefore, the vehicle safety may be further improved.

In addition, according to an electric door latch apparatus for a vehicle according to an exemplary embodiment, since the child-lock function and deadlock function may be implemented using the sub-motor, the smart and compact vehicle door may be realized, and therefore, the vehicle's marketability may be improved while reducing the number of parts and weight and cost of the vehicle.

According to an electric door latch apparatus for a vehicle according to an exemplary embodiment, since the main motor and sub-motor are configured in adjacent positions, the power supply structure connected to the motors may be optimized, while performing the above door functions.

Other effects that may be obtained or are predicted by an exemplary embodiment will be explicitly or implicitly described in a detailed description of the present invention. That is, various effects that are predicted according to exemplary embodiments will be described in the following detailed description.

Figure 1:
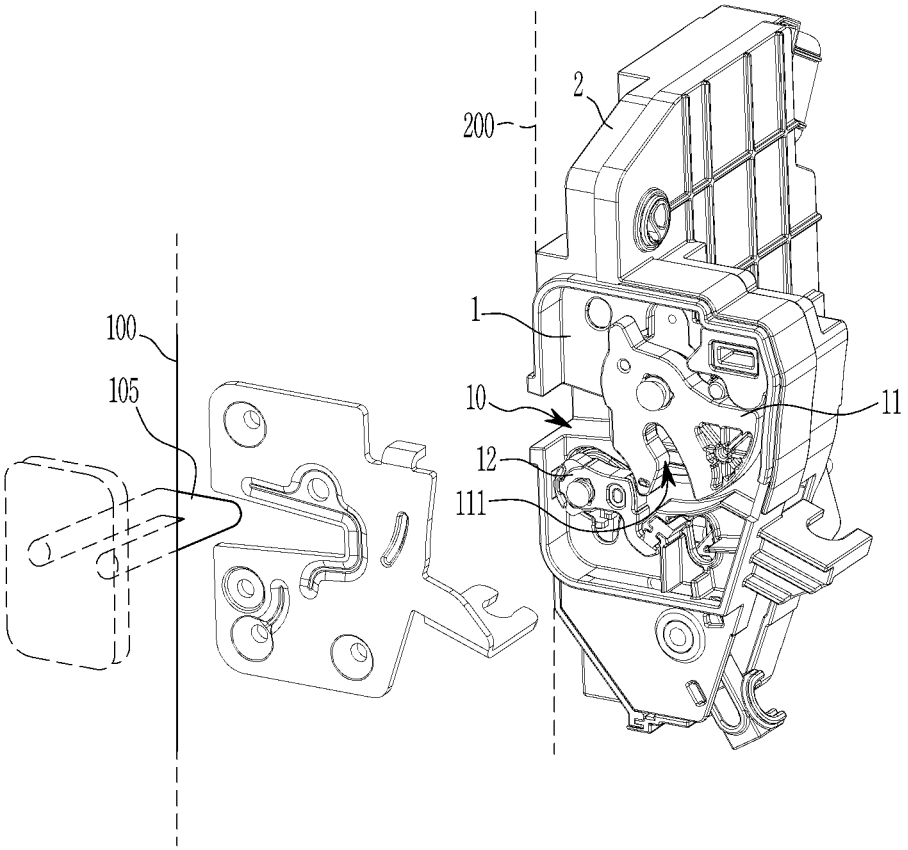
FIG. 1 is a perspective view along a first direction of an electric door latch apparatus for a vehicle according to an exemplary embodiment.

The following reference symbols can be used in conjunction with the drawings:

| | |
|---|---|
| 1: first base plate | 2: second base plate |
| 10: catching part | 11: catch |
| 111: locking indentation | 12: pawl |
| 13: pawl release lever | 131: seated protrusion |
| 20: door locking and unlocking part | 21: main motor |
| 211: main drive gear | 22: main driven gear |
| 23: operation lever | 231: pressurizing protrusion |
| 30: electric emergency door unlocking part | |
| 31: sub-motor | 311: sub-drive gear |
| 32: sub-driven gear | 321: rotation protrusion |
| 33: master lock link | 331: hook |
| 332: rotation inducing flange | 333: pin shaft |
| 335: stopping protrusion | 34: pressurizing spring |
| 40: inside emergency operation lever | 41: inside handle wire |
| 42: pressurizing flange | 43: pushing flange |
| 45: return spring | 49: inside handle |
| 50: outside emergency operation lever | 51: outside handle wire |
| 52: first long hole | 53: wiring recess |
| 59: outside handle | 60: key nut |
| 61: first operation protrusion | 62: second operation protrusion |
| 63: movable recess | 70: key lever |
| 71: second long hole | 72: catching end |
| 73: position regulating recess | 75: catching step |
| 77: mounting protrusion | 80: manual emergency door unlocking part |
| 81: first connection protrusion | 82: second connection protrusion |
| 83: compression spring | 90: parking switch |
| 92: child-lock switch | 94: deadlock switch |
| 100: vehicle body | 105: striker |
| 200: door | |

DETAILED DESCRIPTION OF ILLUSTRATIVE EMBODIMENTS

Hereinafter, the present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In order to clarify the present invention, parts that are not connected to the description will be omitted, and the same elements or equivalents are referred to with the same reference numerals throughout the specification.

In the following description, dividing names of components into first, second, and the like is to divide the names because the names of the components are the same as each other, and an order thereof is not particularly limited.

In addition, unless explicitly described to the contrary, the word "comprise", and variations such as "comprises" or "comprising", will be understood to imply the inclusion of stated elements but not the exclusion of any other elements.

Typically, a vehicle length direction, i.e., a moving direction of a vehicle in an assembly line, is called a T direction, a vehicle width direction is called an L direction, and a vehicle height direction is called an H direction. However, in an exemplary embodiment, front and rear, left and right, and up and down directions in the drawings are taken as reference directions, instead of taking the LTH directions as reference directions. However, the above definition of the reference directions has a relative meaning, and since the directions may vary according to a reference position of an apparatus or its component part according to an exemplary embodiment, the above-mentioned reference direction is not necessarily limiting a reference direction of the present disclosure.

Figure 2:
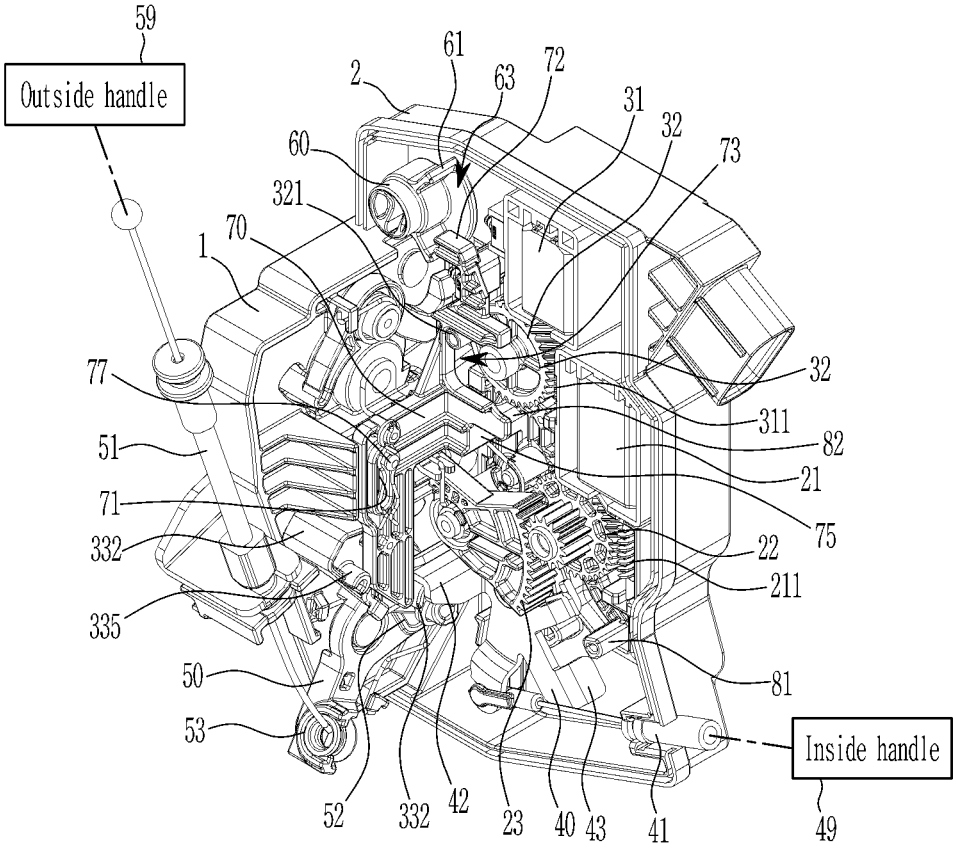
FIG. 2 is a perspective view along a second direction of an electric door latch apparatus for a vehicle according to an exemplary embodiment.
Figure 3:
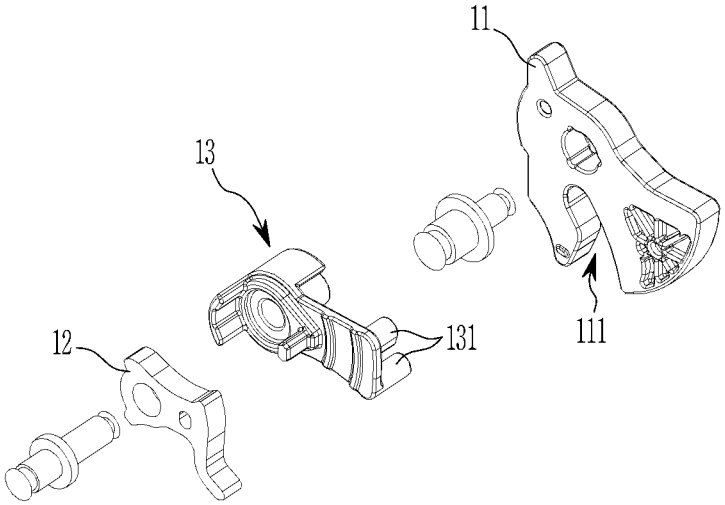
FIG. 3 is an exploded perspective view of a catching part applied to an electric door latch apparatus for a vehicle according to an exemplary embodiment.
Figure 4:
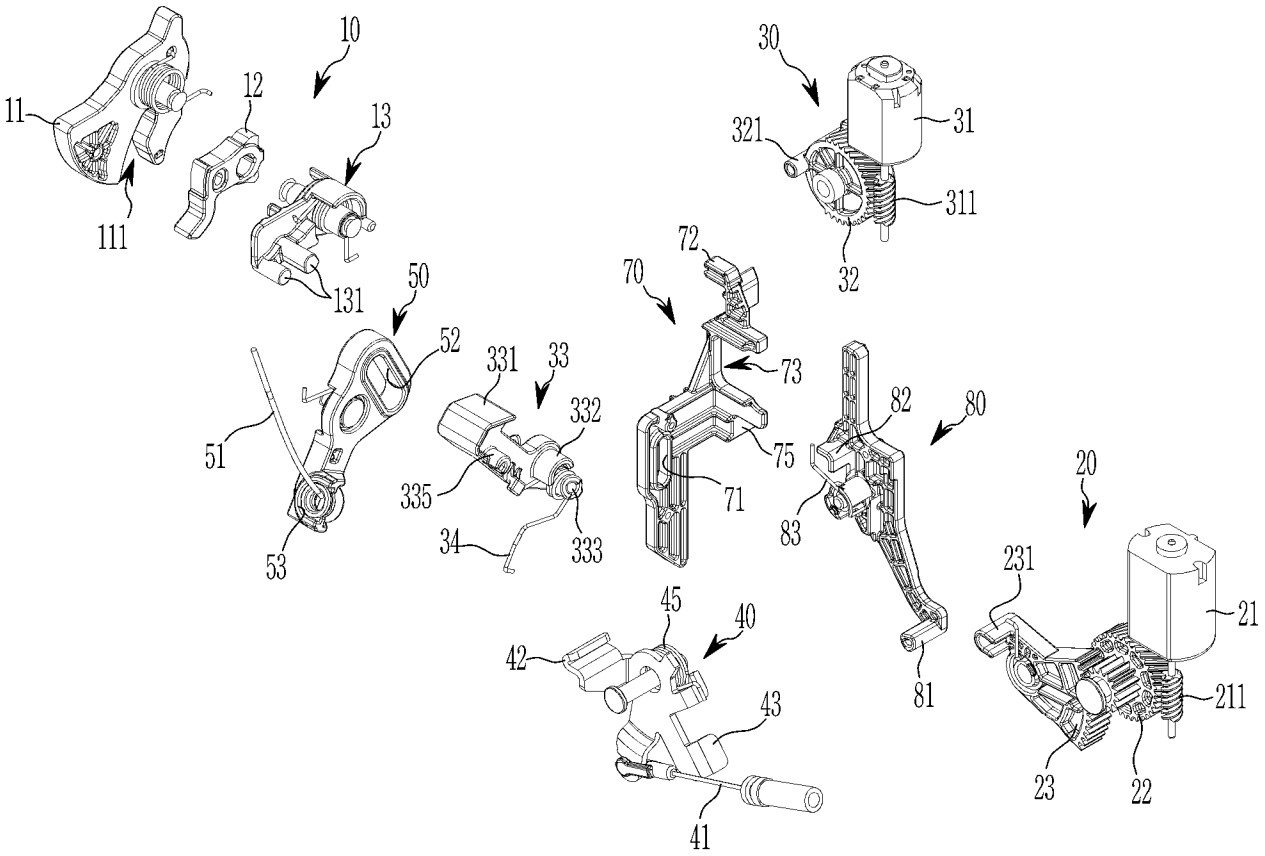
FIG. 4 is an exploded perspective view of a door locking and unlocking part and an electric and manual emergency door unlocking part applied to an electric door latch apparatus for a vehicle according to an exemplary embodiment.

FIG. 1 is a perspective view along a first direction of an electric door latch apparatus for a vehicle according to an exemplary embodiment. FIG. 2 is a perspective view along a second direction of an electric door latch apparatus for a vehicle according to an exemplary embodiment. FIG. 3 is an exploded perspective view of a catching part applied to an electric door latch apparatus for a vehicle according to an exemplary embodiment. FIG. 4 is an exploded perspective view of a door locking and unlocking part and an electric and manual emergency door unlocking part applied to an electric door latch apparatus for a vehicle according to an exemplary embodiment.

Referring to FIG. 1 and FIG. 2, an electric door latch apparatus for a vehicle according to an exemplary embodiment is formed in a structure in which various component parts are mounted on a first base plate 1 and a second base plate 2.

The electric door latch apparatus for a vehicle is mounted on a door 200 of the vehicle through the first base plate 1 and the second base plate 2 and configured to lock and unlock the door 200 from the vehicle body 100.

The electric door latch apparatus for a vehicle is configured to lock and unlock the door 200 from the vehicle body 100 by hooking or releasing a catch 11 configured on the door 200 to a striker 105 mounted on the vehicle body 100.

Such an electric door latch apparatus for a vehicle includes a catching part 10, a door locking and unlocking part 20, an electric emergency door unlocking part 30, an inside emergency operation lever 40, an outside emergency operation lever 50, and a manual emergency door unlocking part 80.

The catching part 10 is caught by the striker 105 mounted on the vehicle body 100 to lock the door 200 to the vehicle body 100 or is released from the striker 105 to unlock the door 200 from the vehicle body 100. The door locking and unlocking part 20 applies torque to the catching part 10 to allow the catching part 10 to be locked or unlocked by the striker 105. The emergency door locking and unlocking part 80 allows the door 200 locked to the vehicle body 100 to be released from the vehicle body 100 when the door locking and unlocking part 20 is inoperable due to a battery discharge or collision accident.

Referring to FIG. 3, the catching part 10 is rotatably mounted on one side of the first base plate 1.

The catching part 10 includes the striker 105 mounted on the vehicle body 100 and formed with the locking indentation 111 where the striker 105 mounted on the vehicle body 100 is inserted or released, a pawl 12 rotatably mounted on the first base plate 1 to be in close contact with the catch 11, and a pawl release lever 13 disposed between the pawl 12 and the first base plate 1 and rotatable integrally with the pawl 12.

That is, the catch 11 is rotatably mounted on the first base plate 1, and is formed with a locking indentation 11 configured to catch or release the striker 105. The pawl 12 is rotatably mounted on the first base plate 1 while contacting the catch 11, and is configured to stop the rotation of the catch 11 or to enable the catch 11 to freely rotate.

At this time, the pawl 12 may rotate into a rotation trajectory of the catch 11 to stop the rotation of the catch 11, or may rotate away from the rotation trajectory of the catch 11 to enable the catch 11 to freely rotate.

Referring to FIG. 4, the door locking and unlocking part 20 may include a main motor 21 mounted on the second base plate 2, a main driven gear 22 engaged with the main motor 21, and a main operation lever 23 engaged with the main driven gear 22 to rotate the pawl release lever 13.

The main motor 21 is provided with a main drive gear 211 formed on a rotation shaft, and the main driven gear 22 is fixed on the main drive gear 211.

The main motor 21 may be formed in various types of electric motors.

The main operation lever 23 is mounted on the second base plate 2 while being engaged with the main driven gear 22, rotates by receiving a torque from the main driven gear 22, and thereby rotates the pawl release lever 13.

The pawl release lever 13 is formed with two seated protrusions 131. The main operation lever 23 is provided with a pressurizing protrusion 231 to be placed on the seated protrusions 131 to press and rotate the pawl release lever 13.

The electric emergency door unlocking part 30 includes a sub-motor 31 mounted on the second base plate 2, a sub-driven gear 32 engaged with the sub-motor 31, a master lock link 33 rotatably mounted on the first base plate 1, and a pressurizing spring 34 pressing the master lock link 33 to rotate clockwise.

The sub-motor 31 is disposed at a position adjacent to the main motor 21, and is provided with a sub-drive gear 311 formed on a rotation shaft that is rotatable in both directions. The sub-driven gear 32 is engaged with the sub-drive gear 311.

The sub-motor 31 may be formed in various types of electric motors.

A rotation protrusion 321 is integrally formed on the sub-driven gear 32 engaged with the sub-motor 31.

The sub-driven gear 32 is formed such that the rotation protrusion 321 is disposed correspondingly to a position regulating recess 73 of a key lever 70 that is described below, and the rotation protrusion 321 moves on the position regulating recess 73 according to the rotation operation of the sub-driven gear 32, to regulate the position of the key lever 70 in an up and down direction.

In addition, the master lock link 33 is rotatably mounted on the first base plate 1, and is formed with a hook 331.

The hook 331 is configured to be caught by the seated protrusions 131 of the pawl release lever 13 when the master lock link 33 rotates.

The master lock link 33 is formed with a stopping protrusion 335 at a position adjacent to the hook 331, and a rotation angle of the master lock link 33 may be regulated through the stopping protrusion 335 and the key lever 70.

In addition, as shown in the drawings, the inside emergency operation lever 40 is rotatably mounted on the second base plate 2. A first radial end of the inside emergency operation lever 40 is connected to the master lock link 33 through a pressurizing flange 42. A second radial end of the inside emergency operation lever 40 is connected to the manual emergency door unlocking part 80 through a pushing flange 43. A third radial end of the inside emergency operation lever 40 between the first and second ends is connected to an inside handle 49 through an inside handle wire 41.

In addition, the inside emergency operation lever 40 is provided with a return spring 45 to return the inside emergency operation lever 40 to an original position. The return spring 45 may be mounted on a rotation shaft of the inside emergency operation lever 40 mounted on the second base plate 2.

In addition, as shown in the drawings, the outside emergency operation lever 50 is rotatably mounted on the first base plate 1. A first end of the outside emergency operation lever 50 is formed with a wiring recess 53 that is connected to an outside handle wire 51 connected to an outside handle 59. A second end of the outside emergency operation lever 50 is formed with a first long hole 52 through which a pin shaft 333 provided at the master lock link 33 inserted.

The outside emergency operation lever 50 is connected to the master lock link 33 through the pin shaft 333, and accordingly, when the outside handle 59 is operated, the master lock link 33 rotates while moving in the first long hole 52.

Meanwhile, a first end of the manual emergency door unlocking part 80 is connected to the pushing flange 43 of the inside emergency operation lever 40, and a central portion of the manual emergency door unlocking part 80 is connected to the key lever 70.

In more detail, the manual emergency door unlocking part 80 is formed with a first connection protrusion 81 that protrudes correspondingly to the pushing flange 43, at a first end portion corresponding to the inside emergency operation lever 40.

The first connection protrusion 81 is configured to rotate by the operation of the inside emergency operation lever 40.

The manual emergency door unlocking part 80 is configured to move up by being coupled with the pushing flange 43 through the first connection protrusion 81 when the inside emergency operation lever 40 operates.

In addition, the manual emergency door unlocking part 80 is formed with a second connection protrusion 82 that is positioned and protrudes on an upper portion of a catching step 75 formed on a central portion of the key lever 70.

The manual emergency door unlocking part 80 is configured to move the key lever 70 through a compression spring 83.

The compression spring 83 is disposed adjacent to the second connection protrusion 82, and moves the key lever 70 according to the operation of the inside emergency operation lever 40.

A mounting protrusion 77 integrally formed on the first base plate 1 is inserted into a second long hole 71 formed at a first central portion of the key lever 70 such that the key lever 70 may be supported by the mounting protrusion 77 of the first base plate 1. An upper end portion of the key lever 70 is connected to a key nut 60, into which a vehicle key is inserted and rotated, and a lower end portion of the key lever 70 is connected to the master lock link 33.

In addition, the position regulating recess 73 is formed on a second central portion of the key lever 70. The position regulating recess 73 corresponds to the rotation protrusion 321 of the sub-driven gear 32 and regulates the operation position of the sub-driven gear 32. In addition, the catching step 75 is formed at a position adjacent to the position regulating recess 73. The catching step 75 corresponds to the second connection protrusion 82 of the manual emergency door unlocking part 80 and regulates the operation of the manual emergency door unlocking part 80.

As the manual emergency door unlocking part 80 moves up, the compression spring 83 is compressed between the manual emergency door unlocking part 80 and the catching step 75, and thereby the key lever 70 moves up together with the manual emergency door unlocking part 80.

That is, the key lever 70 may move up by an operation of the sub-motor 31, an operation of the manual emergency door unlocking part 80, and an operation of the key nut 60, to promote a rotation of the master lock link 33.

Subsequently, an operation of an electric door latch apparatus for a vehicle according to an exemplary embodiment for various situations is hereinafter described.

An electric door latch apparatus for a vehicle according to an exemplary embodiment may realize a two-motion override operation mechanism where a locked state of the door 200 is released when the inside handle 49 or the outside handle 59 is operated once (first motion), and the catch 11 is released from the striker 105 of the vehicle body 100 when consecutively operated again (second motion).

Figure 5:
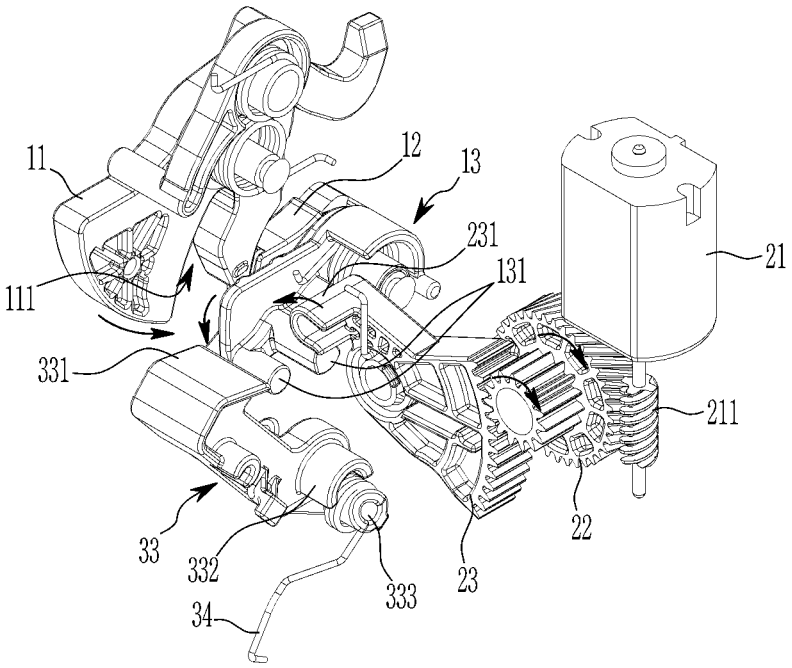
FIG. 5 illustrates an operation of a door locking and unlocking part of a door latch applied to an electric door latch apparatus for a vehicle according to an exemplary embodiment.

FIG. 5 illustrates an operation of a door locking and unlocking part of a door latch applied to an electric door latch apparatus for a vehicle according to an exemplary embodiment.

For a normal opening of the door 200, when a user operates a switch, such as an inside button switch or an outside button switch installed in the door 200, a controller (refer to C shown in FIG. 14) detects the operation and drives the main motor 21 by applying an operation signal to the main motor 21.

Referring to FIG. 5, by the operation of the main motor 21, the main drive gear 211 and the main driven gear 22 respectively rotate, the main operation lever 23 engaged with the main driven gear 22 rotates to press and rotate the pawl release lever 13, the pawl 12 rotates together with the pawl release lever 13 to depart from the rotation trajectory of the catch 11, the catch 11 becomes freely rotatable, and thereby the vehicle body-locked state of the door 200 is released and the door 200 may be opened.

In this case, when the user pushes or pulls the door 200 with the inside handle 49 or the outside handle 59 installed on the door 200, the door 200 is rotated and opened while one end of the door 200 is supported by the vehicle body 100.

Figure 6:
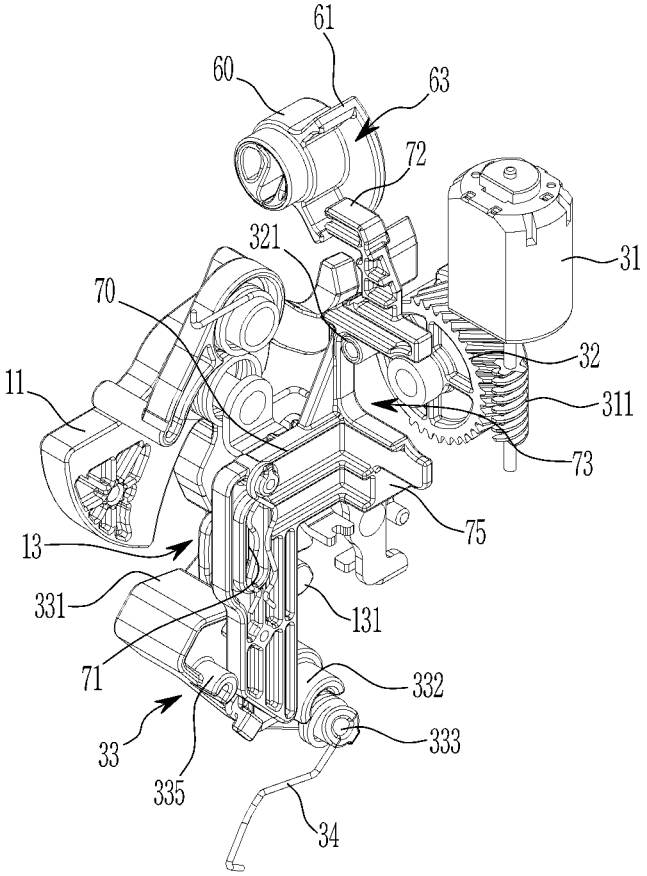
FIG. 6 illustrates an operation of an electric emergency door unlocking part applied to an electric door latch apparatus for a vehicle according to an exemplary embodiment.
Figure 7:
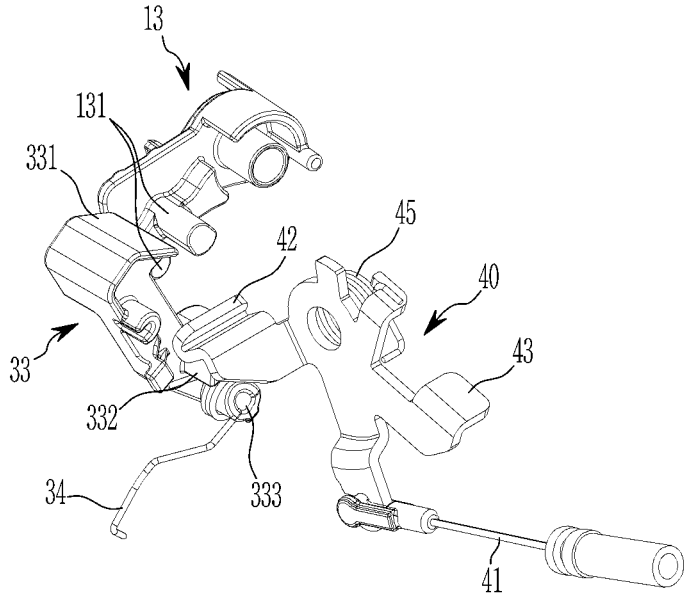
FIG. 7 illustrates an operation of an inside emergency operation lever and a master lock link applied to an electric door latch apparatus for a vehicle according to an exemplary embodiment.
Figure 8:
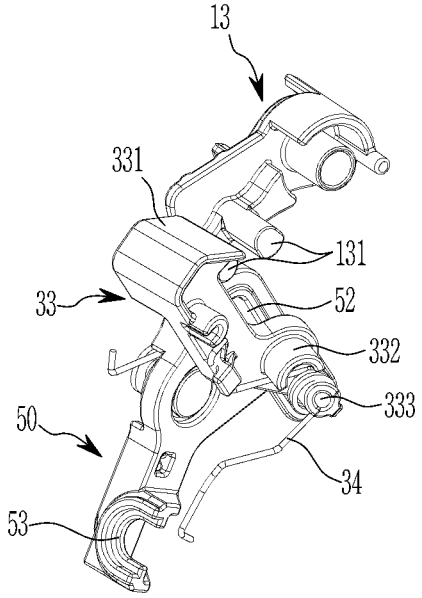
FIG. 8 illustrates an operation of an outside emergency operation lever and a master lock link applied to an electric door latch apparatus for a vehicle according to an exemplary embodiment.

FIG. 6 illustrates an operation of an electric emergency door unlocking part applied to an electric door latch apparatus for a vehicle according to an exemplary embodiment. FIG. 7 illustrates an operation of an inside emergency operation lever and a master lock link applied to an electric door latch apparatus for a vehicle according to an exemplary embodiment. FIG. 8 illustrates an operation of an outside emergency operation lever and a master lock link applied to an electric door latch apparatus for a vehicle according to an exemplary embodiment.

If the main motor 21 is inoperable due to a collision accident of a vehicle, the controller C detects the collision by a collision detecting sensor (not shown), and applies an operation signal to the sub-motor 31 to operate the sub-motor 31.

Referring to FIG. 6, by a positive direction operation of the sub-motor 31, the sub-drive gear 311 as well as the sub-driven gear 32 rotates and the key lever 70 moves up by a clockwise rotation of the sub-driven gear 32.

At this time, the master lock link 33 is released from the key lever 70 and rotates clockwise by the elastic force of the pressurizing spring 34, and the hook 331 of the master lock link 33 is caught by the seated protrusions 131 of the pawl release lever 13, which is a door lock release ready state that is ready for a door lock release.

Referring to FIG. 7, in such a door lock release ready state, when an occupant inside the vehicle pulls the inside handle 49 to open the door 200, the inside emergency operation lever 40 connected to the inside handle 49 through the inside handle wire 41 rotates.

A rotation inducing flange 332 is formed in a circular arc shape on the master lock link 33 correspondingly to the pressurizing flange 42 of the inside emergency operation lever 40.

The pressurizing flange 42 rotates with the inside emergency operation lever 40 to press the rotation inducing flange 332 of the master lock link 33. In this case, in the door lock release ready state in which the master lock link 33 is caught by the seated protrusions 131 of the pawl release lever 13, the master lock link 33 moves down along the first long hole 52 of the outside emergency operation lever 50, and simultaneously, further rotates clockwise, to rotate the pawl release lever 13 counterclockwise.

At this time, the pawl 12 rotates with the pawl release lever 13 and departs from the rotation trajectory of the catch 11. Accordingly, the catch 11 becomes freely rotatable, and the vehicle body-locked state of the door 200 is released, to be able to open the door 200.

Referring to FIG. 8, in the door lock release ready state (refer to FIG. 6), when an outside user pulls the outside handle 59 in order to open the door 200, the outside emergency operation lever 50 connected to the outside handle 59 through the outside handle wire 51 rotates.

As the outside emergency operation lever 50 rotates, by the rotation of the outside emergency operation lever 50, the master lock link 33 moves down along the first long hole 52 and presses the pawl release lever 13 to rotate the pawl release lever 13 counterclockwise.

At this time, the pawl 12 rotates with the pawl release lever 13, and departs from the rotation trajectory of the catch 11. Accordingly, the catch 11 becomes freely rotatable, and the vehicle body-locked state of the door 200 is released to be able to open the door 200.

Figure 9:
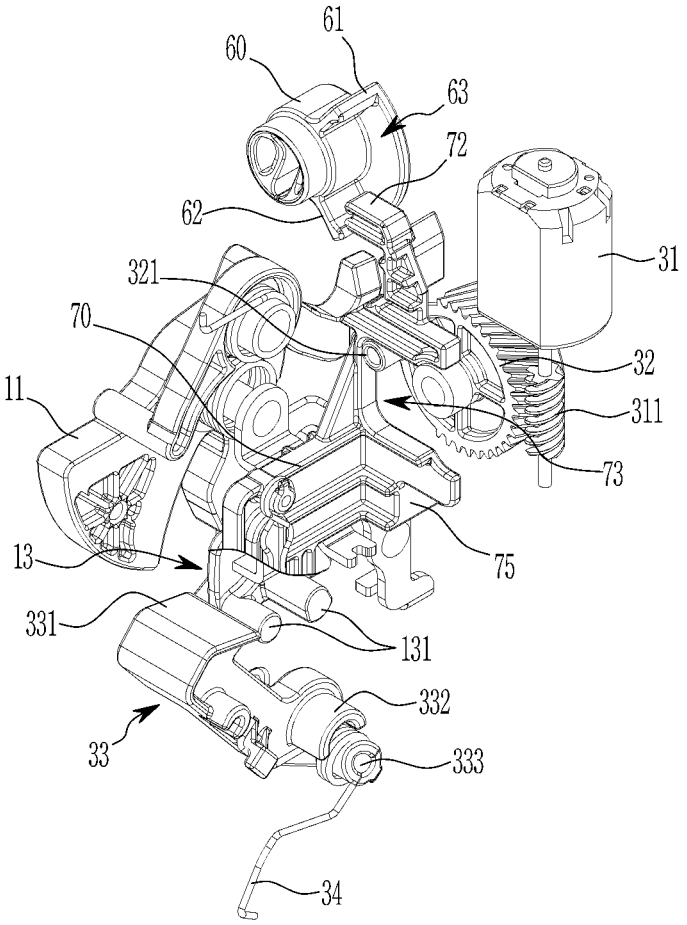
FIG. 9 and FIG. 10 illustrate operation of an electric door latch apparatus for a vehicle according to an exemplary embodiment, by using a master key of a vehicle when fully discharged.
Figure 10:
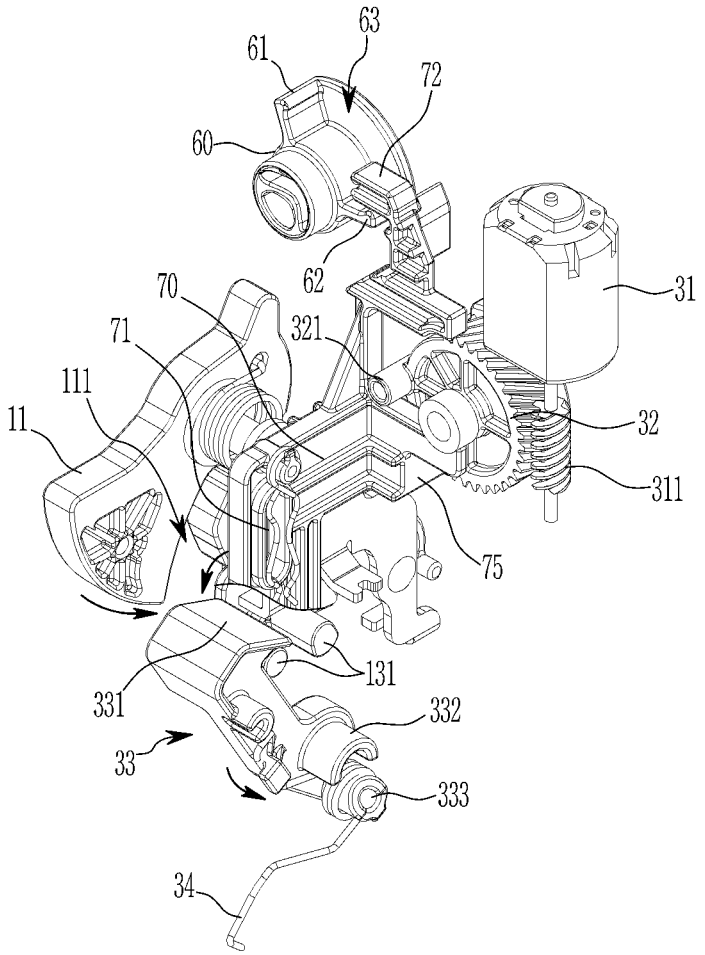

FIG. 9 and FIG. 10 illustrate operation of an electric door latch apparatus for a vehicle according to an exemplary embodiment, by using a master key of a vehicle when fully discharged.

The key lever 70 is partially cutaway in FIG. 9 and FIG. 10 for convenience of description and better comprehension.

Even when the vehicle is discharged and the main motor 21 and the sub-motor 31 are simultaneously inoperable, the door 200 of the vehicle must be able to be opened.

Referring to FIG. 9, in the case that the door 200 is opened using the master key from the outside of the vehicle, when the master key is inserted into the key hole (not shown) and rotated, the key nut 60 connected to the key hole rotates, and the key lever 70 moves up by the rotation of the key nut 60.

Referring to FIG. 10, the master lock link 33 is released from the key lever 70 and rotates clockwise by the elastic force of the pressurizing spring 34, the hook 331 of the master lock link 33 is caught by the seated protrusions 131 of the pawl release lever 13, which is a door lock release ready state that is ready for a door lock release.

When the outside handle 59 is pulled in such a door lock release ready state, as shown in FIG. 8, the outside emergency operation lever 50 rotates to open the door 200.

In order to achieve such an operation according to a key operation, the key nut 60 is provided with two operation protrusions of a first operation protrusion 61 and a second operation protrusion 62 that are spaced apart from each other.

A movable recess 63 may be formed between the first operation protrusion 61 and the second operation protrusion 62 such that a catching end 72 of the key lever 70 may be inserted into the movable recess 63 and movable in the movable recess 63.

Figure 11:
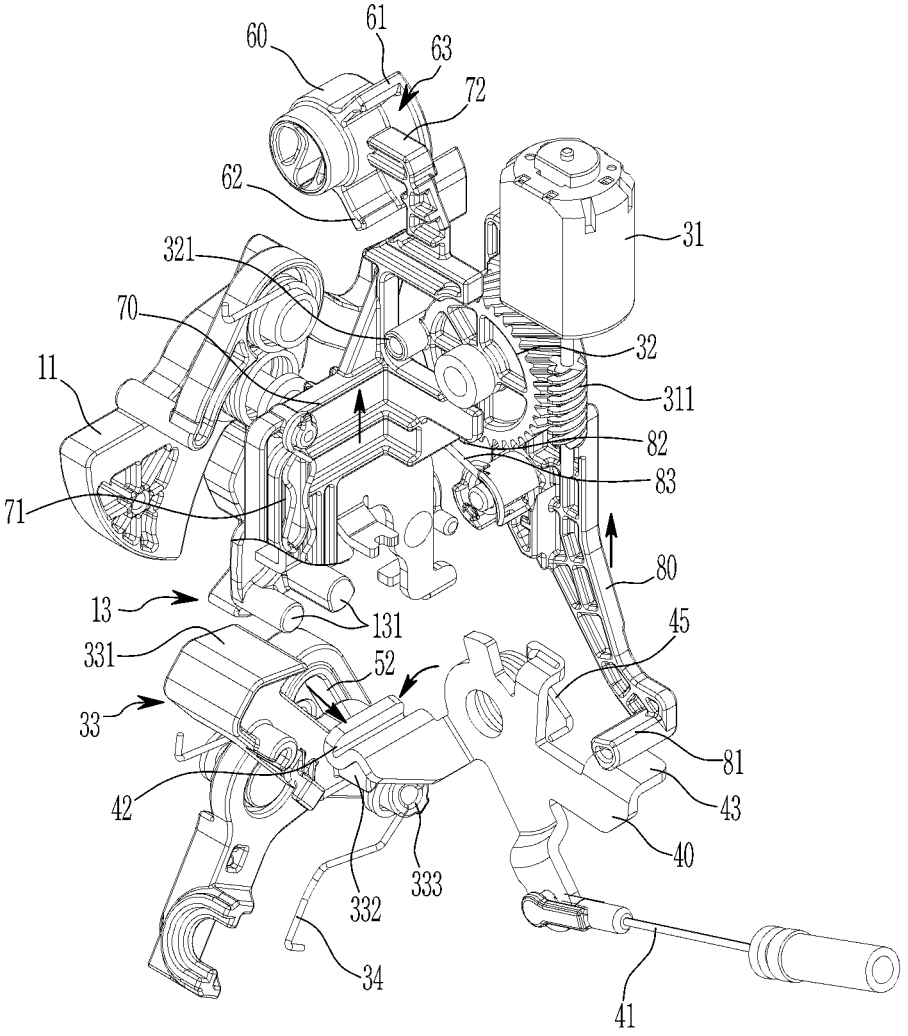
FIG. 11 to FIG. 13 illustrate an operation of an electric door latch apparatus for a vehicle according to an exemplary embodiment, by using an inside handle when fully discharged.
Figure 12:
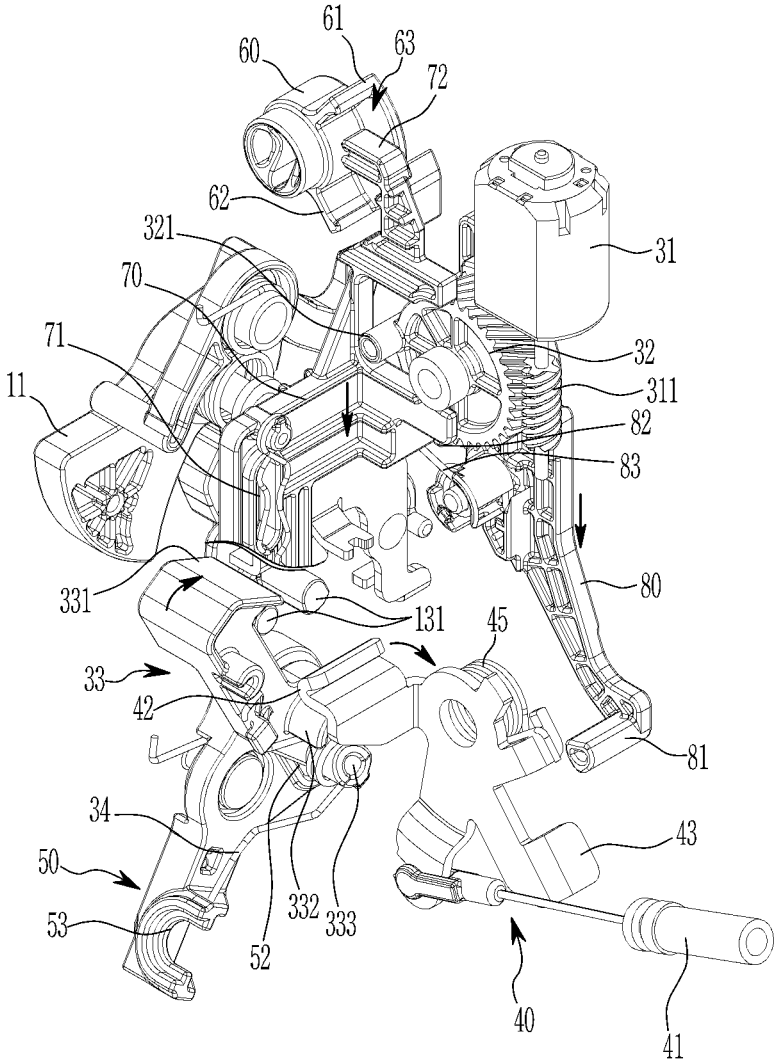
Figure 13:
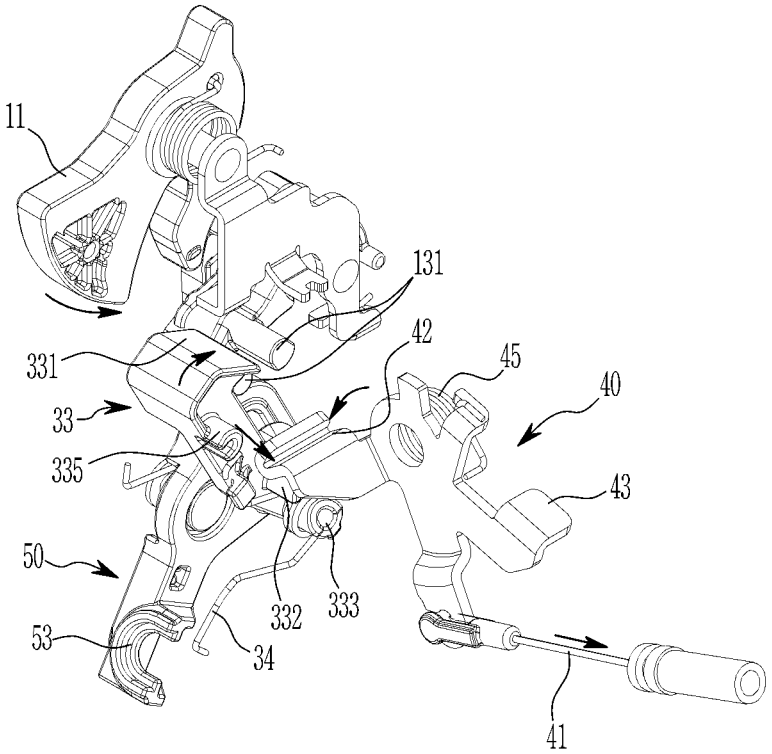

FIG. 11 to FIG. 13 illustrate an operation of an electric door latch apparatus for a vehicle according to an exemplary embodiment, by using an inside handle when fully discharged.

The key lever 70 is partially cutaway in FIG. 11 to FIG. 13 for convenience of description and better comprehension.

Even when both the main motor 21 and the sub-motor 31 are simultaneously inoperable, the door 200 locked to the vehicle should be capable of being released by operating the key nut 60 with the vehicle key from the outside of the vehicle, and the door 200 should also be capable of being opened by an occupant inside the vehicle.

For such a purpose, the pressurizing flange 42 is formed at a first end of the inside emergency operation lever 40, and the pushing flange 43 configured to push the manual emergency door unlocking part 80 is formed at a second end of the inside emergency operation lever 40.

Accordingly, in the case that the main motor 21 and the sub-motor 31 are simultaneously inoperable, an occupant inside the vehicle may pull the inside handle 49 once (first motion) in order to manually open the door 200. Then, as shown in FIG. 11, the inside emergency operation lever 40 connected to the inside handle 49 rotates about its rotation shaft. At this time, the manual emergency door unlocking part 80 moves up and the compression spring 83 mounted on the manual emergency door unlocking part 80 is compressed, thereby moving the key lever 70 upward.

As the key lever 70 moves up, the master lock link 33 connected to the lower end portion of the key lever 70 is released from the key lever 70 and rotates clockwise by the elastic force of the pressurizing spring 34, and the hook 331 of the master lock link 33 is caught by the seated protrusions 131 of the pawl release lever 13, which is a door lock release ready state that is ready for a door lock release.

In this state, if an occupant releases the inside handle 49, as shown in FIG. 12, the inside emergency operation lever 40 and the manual emergency door unlocking part 80 return to original positions by the elastic force of the compression spring 83. However, the door lock release ready state is maintained where the hook 331 of the master lock link 33 is caught by the seated protrusions 131 of the pawl release lever 13.

In such a door lock release ready state, the occupant may consecutively operate again the inside handle 49 installed in the door 200 in order to open the door 200 (second motion). Then, as shown in FIG. 13, the inside emergency operation lever 40 rotates again in the door lock release ready state. Accordingly, the pressurizing flange 42 rotates by the inside emergency operation lever 40, and presses the rotation inducing flange 332 of the master lock link 33.

At this time, in the door lock release ready state in which the master lock link 33 is caught by the seated protrusions 131 of the pawl release lever 13, the master lock link 33 moves down along the first long hole 52 and presses the pawl release lever 13 to rotate the pawl release lever 13 counterclockwise.

Therefore, the pawl 12 rotates with the pawl release lever 13.

Thereby, the pawl 12 departs from the rotation trajectory of the catch 11. Accordingly, the catch 11 becomes freely rotatable, and the vehicle body-locked state of the door 200 is released to be able to open the door 200.

Meanwhile, when driving, the door 200 must not be opened from inside the vehicle.

For example, when an occupant inside the vehicle operates the inside handle 49 while driving, as shown in FIG. 11, door lock release ready state is initially achieved, however, the controller C of the vehicle perceives that the vehicle is being driven, and operates the sub-motor 31 in a reverse direction. Then, the sub-driven gear 32 rotates counterclockwise, and the key lever 70 moves down to return to the initial state. As a result, the hook 331 of the master lock link 33 is not caught by the seated protrusions 131 of the pawl release lever 13.

Even if the occupant operates again the inside handle 49, the above operation is performed again and the door 200 is not opened.

Figure 14:
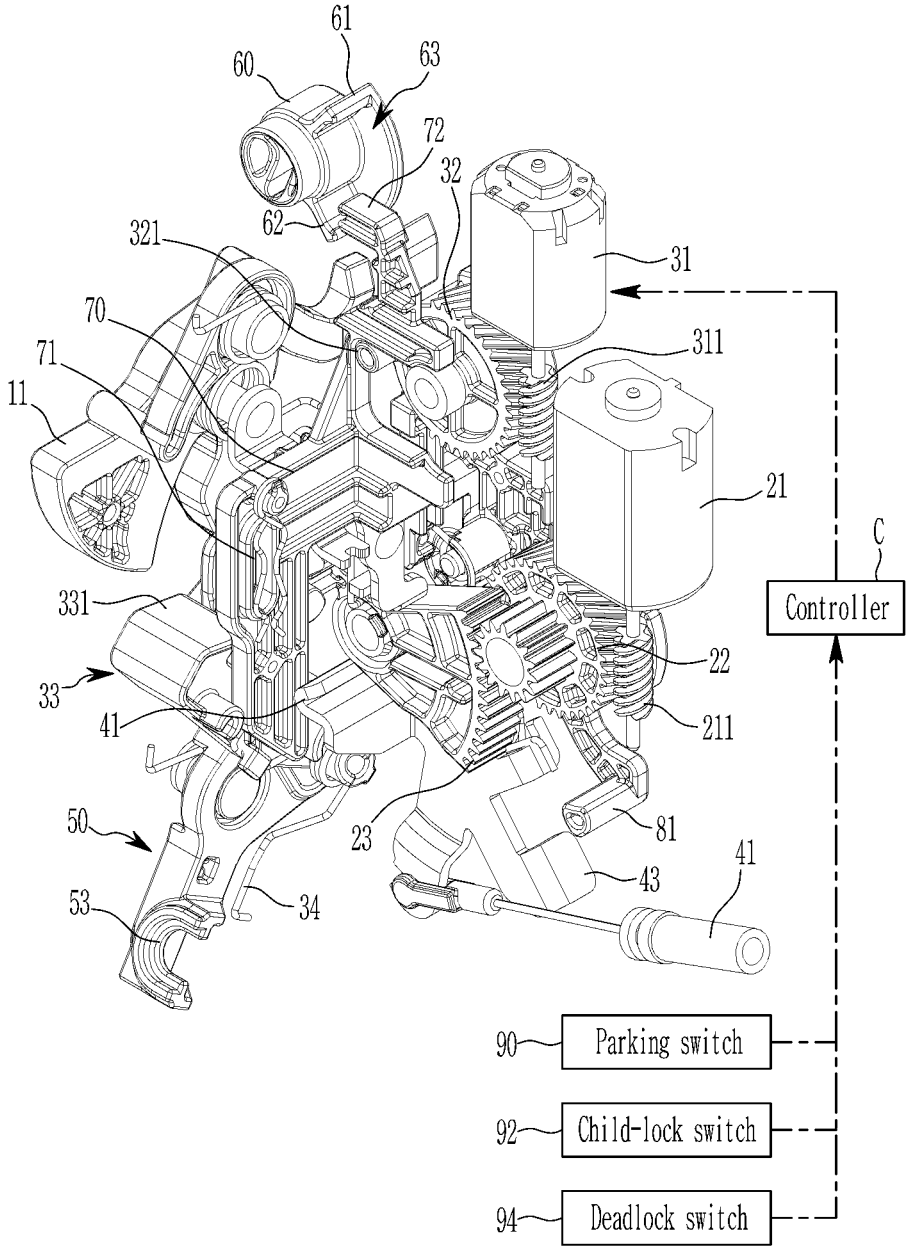
FIG. 14 illustrates an operation of a child-lock function and a deadlock function of an electric door latch apparatus for a vehicle according to an exemplary embodiment.

FIG. 14 illustrates an operation of a child-lock function and a deadlock function of an electric door latch apparatus for a vehicle according to an exemplary embodiment.

Referring to FIG. 14, according to an embodiment, a child-lock function that is applied only to a rear seat of the vehicle may be achieved.

That is, the child-lock function is a function to prevent the door 200 of the rear seat of the vehicle from being opened from inside of the vehicle when a child-lock switch 92 is turned on, and may be realized as follows.

When an occupant on the rear seat operates the inside handle 49 in order to open the door 200 while the child-lock switch 92 is turned on, the inside emergency operation lever 40 connected to the inside handle 49 rotates about its rotation shaft, and moves up the manual emergency door unlocking part 80. Accordingly, the key lever 70 also moves up by the compression spring 83 mounted on the manual emergency door unlocking part 80.

At this time, the controller C detects that the child-lock switch 92 is turned on, and operates the sub-motor 31 in the reverse direction. Accordingly, the sub-driven gear 32 rotates counterclockwise.

Then, the key lever 70 moves down by being caught by the rotation protrusion 321 of the sub-driven gear 32, and accordingly, the master lock link 33 is not rotated. Therefore, the rear door 200 does not achieve the door lock release ready state and maintains a state of being locked to the vehicle body 100.

That is, child-lock function in which the rear door 200 is not opened is realized.

When the occupant on the rear seat releases the inside handle 49, the inside emergency operation lever 40 and the manual emergency door unlocking part 80 move down to return to original positions. Then, even if the occupant on the rear seat operates again the inside handle 49 in order to open the rear door 200, the above operation is performed again and the rear door 200 is not opened while the child-lock switch 92 is turned on.

Meanwhile, a deadlock function may be realized as follows. The deadlock function is a function that prevents the door 200 of the vehicle from being opened.

For example, while a deadlock switch 94 is turned on after parking the vehicle, a vehicle usurper may enter the vehicle interior after breaking a window of the vehicle, and then operate the inside handle 49 in order to open the door 200. In this case, the controller C detects a parked state by a parking switch 90, recognizes the activation of the deadlock switch 94, and detects a moving up operation of the manual emergency door unlocking part 80 according to the operation of the inside handle 49 by the usurper. Accordingly, the controller C operates the sub-motor 31 in the reverse direction, and thereby moves down the manual emergency door unlocking part 80 together with the key lever 70.

Accordingly, the same as in the child-lock situation, even if the inside emergency operation lever 40 is operated by the operation of the inside handle 49, the moving up operation of the manual emergency door unlocking part 80 is prevented by the operation of the sub-motor 31, thereby preventing the door lock release ready state, and accordingly, the door 200 of the vehicle may not be opened.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. An electric door latch apparatus, comprising:

a catching part mounted on a first base plate and configured to catch a striker that is to be mounted on a vehicle body to lock a door to the vehicle body or to be released from the striker to unlock the door from the vehicle body;

a door locking and unlocking part configured to apply a torque to the catching part through a main motor mounted on a second base plate such that the catching part is locked and unlocked to the striker;

an electric emergency door unlocking part configured to enable the door to be released from the vehicle body through a sub-motor mounted on the second base plate when the main motor is inoperable;

an inside emergency operation lever connected to an inside handle installed in the door, rotatable by an operational force of the inside handle, and configured to apply a torque to the catching part through the electric emergency door unlocking part;

an outside emergency operation lever connected to an outside handle installed in the door, rotatable by an operational force of the outside handle, and configured to apply a torque to the catching part through the electric emergency door unlocking part; and a manual emergency door unlocking part mounted on the second base plate, connected to the inside emergency operation lever, and configured to apply a torque to the catching part through the electric emergency door unlocking part by a torque of the inside emergency operation lever;

wherein the catching part comprises:

a catch rotatably mounted on the first base plate, and formed with a locking indentation configured to catch or release the striker;

a pawl rotatably mounted on the first base plate while contacting the catch, and configured to stop rotation of the catch or to enable the catch to freely rotate; and a pawl release lever disposed between the pawl and the first base plate and rotatable integrally with the pawl.

2. The electric door latch apparatus of claim 1, wherein the door locking and unlocking part comprises:

the main motor mounted on the second base plate and including a main drive gear formed on a rotation shaft rotatable in both directions;

a main driven gear engaged with the main drive gear; and a main operation lever engaged with the main driven gear and configured to rotate the pawl release lever by being rotated by a torque from the main driven gear.

3. The electric door latch apparatus of claim 2, wherein:

the pawl release lever is formed with two seated protrusions; and the main operation lever is formed with a pressurizing protrusion to be placed on the seated protrusions to press and rotate the pawl release lever.

4. The electric door latch apparatus of claim 2, wherein the electric emergency door unlocking part comprises:

the sub-motor mounted on the second base plate at a position adjacent to the main motor, the sub-motor including a sub-drive gear formed on a second rotation shaft rotatable in both directions;

a sub-driven gear engaged with the sub-drive gear;

a master lock link rotatably installed on the first base plate, coupled with the outside emergency operation lever, and formed with a hook; and a pressurizing spring configured to press the master lock link to rotate in a predetermined direction.

5. The electric door latch apparatus of claim 4, wherein:

the inside emergency operation lever is rotatably installed on the second base plate to be rotatable by an operation of the inside handle, and formed with a pressurizing flange; and the master lock link comprises a rotation inducing flange configured to be pressed by the pressurizing flange to rotate the master lock link.

6. The electric door latch apparatus of claim 4, wherein the outside emergency operation lever is rotatably installed on the first base plate to be rotatable by an operation of the outside handle, and is formed with a first long hole into which a pin shaft of the master lock link is inserted.

7. The electric door latch apparatus of claim 4, further comprising a key lever comprising:

a position regulating recess coupled with a rotation protrusion integrally formed on the sub-driven gear so as to regulate a position of the key lever in an up and down direction according to a rotation operation of the sub-driven gear; and a catching end connected to a key nut configured to receive a vehicle key and be rotated.

8. The electric door latch apparatus of claim 7, wherein the key nut comprises a first operation protrusion and a second operation protrusion that are spaced apart from each other to form a movable recess into which the catching end is movably inserted.

9. The electric door latch apparatus of claim 7, wherein:

the key lever comprises a second long hole formed at a first central portion of the key lever; and a mounting protrusion integrally formed on the first base plate is inserted into the second long hole such that the key lever may be supported by the mounting protrusion.

10. The electric door latch apparatus of claim 7, wherein:

the master lock link is formed with a stopping protrusion at a position adjacent to the hook; and a rotation angle of the master lock link is regulated through the stopping protrusion and the key lever.

11. The electric door latch apparatus of claim 7, wherein:

a first end of the manual emergency door unlocking part is connected to a pushing flange of the inside emergency operation lever; and a central portion of the manual emergency door unlocking part is connected to the key lever such that the key lever is configured to be operated by an operation of the inside emergency operation lever.

12. The electric door latch apparatus of claim 11, wherein the manual emergency door unlocking part comprises:

a first connection protrusion that protrudes correspondingly to the pushing flange, at a first end portion corresponding to the inside emergency operation lever, the first connection protrusion configured to rotate by the operation of the inside emergency operation lever;

a second connection protrusion that is positioned and protrudes on an upper portion of a catching step formed on a central portion of the key lever; and a compression spring disposed adjacent to the second connection protrusion, and configured to move the key lever according to an operation of the inside emergency operation lever.

13. The electric door latch apparatus of claim 1, further comprising a controller, wherein, when the main motor is inoperable, the controller is configured to apply an operation signal to the sub-motor to operate the sub-motor.

14. The electric door latch apparatus of claim 13, wherein the inside handle of a rear seat is configured to be operated in order to open the door while a child-lock switch is turned on, and wherein the controller is configured to operate the sub-motor in a reverse direction to maintain the door in a locked state to the vehicle body.

15. The electric door latch apparatus of claim 13, wherein the inside handle is configured to be operated in order to open the door while a parking switch is turned on, and wherein the controller is configured to operate the sub-motor in a reverse direction to maintain the door in a locked state to the vehicle body.

16. An electric door latch apparatus, comprising:

a catching part mounted on a first base plate and configured to catch a striker configured to be mounted on a vehicle body to lock a door to the vehicle body or to be released from the striker to unlock the door from the vehicle body, the catching part including a catch rotatably mounted on the first base plate and a locking indentation configured to catch or release the striker;

a pawl rotatably mounted on the first base plate while contacting the catch, and configured to stop rotation of the catch or to enable the catch to freely rotate; and a pawl release lever disposed between the pawl and the first base plate and rotatable integrally with the pawl, the pawl release lever including two seated protrusions;

a door locking and unlocking part configured to apply a torque to the catching part through a main motor mounted on a second base plate such that the catching part is locked and unlocked to the striker, wherein the door locking and unlocking part includes the main motor mounted on the second base plate and including a main drive gear formed on a first rotation shaft rotatable in both directions, a main driven gear engaged with the main drive gear, and a main operation lever engaged with the main driven gear and configured to rotate the pawl release lever by being rotated by a torque from the main driven gear, wherein the main operation lever is formed with a pressurizing protrusion to be placed on the seated protrusions of the pawl release lever to press and rotate the pawl release lever;

an electric emergency door unlocking part configured to enable the door to be released from the vehicle body when the main motor is inoperable, the electric emergency door unlocking part including:

a sub-motor mounted on the second base plate at a position adjacent to the main motor, the sub-motor including a sub-drive gear formed on a second rotation shaft rotatable in both directions;

a sub-driven gear engaged with the sub-drive gear;

a master lock link rotatably installed on the first base plate and formed with a hook; and a pressurizing spring configured to press the master lock link to rotate in a predetermined direction;

an inside emergency operation lever connected to an inside handle installed in the door, rotatable by an operational force of the inside handle, and configured to apply a torque to the catching part through the electric emergency door unlocking part;

an outside emergency operation lever coupled to the master lock link and connected to an outside handle installed in the door, the outside emergency operation lever rotatable by an operational force of the outside handle and configured to apply a torque to the catching part through the electric emergency door unlocking part; and a manual emergency door unlocking part mounted on the second base plate, connected to the inside emergency operation lever, and configured to apply a torque to the catching part through the electric emergency door unlocking part by a torque of the inside emergency operation lever.

17. The electric door latch apparatus of claim 16, wherein:

the inside emergency operation lever is rotatably installed on the second base plate to be rotatable by an operation of the inside handle, and formed with a pressurizing flange;

the master lock link comprises a rotation inducing flange configured to be pressed by the pressurizing flange to rotate the master lock link; and the outside emergency operation lever is rotatably installed on the first base plate to be rotatable by an operation of the outside handle, and is formed with a first long hole into which a pin shaft of the master lock link is inserted.

18. The electric door latch apparatus of claim 16, further comprising a key lever, the key lever comprising:

a position regulating recess coupled with a rotation protrusion integrally formed on the sub-driven gear so as to regulate a position of the key lever in an up and down direction according to a rotation operation of the sub-driven gear;

a catching end connected to a key nut configured to receive a vehicle key and be rotated, the key nut comprising a first operation protrusion and a second operation protrusion that are spaced apart from each other to form a movable recess into which the catching end is movably inserted; and a second long hole formed at a first central portion of the key lever, wherein a mounting protrusion integrally formed on the first base plate is inserted into the second long hole such that the key lever may be supported by the mounting protrusion.

19. A vehicle comprising:

a vehicle body;

a vehicle door;

a striker mounted on the vehicle body;

a catching part mounted on a first base plate and configured to catch the striker to lock the vehicle door to the vehicle body or to be released from the striker to unlock the vehicle door from the vehicle body;

a door locking and unlocking part configured to apply a torque to the catching part through a main motor mounted on a second base plate such that the catching part is locked and unlocked to the striker;

an electric emergency door unlocking part configured to enable the vehicle door to be released from the vehicle body through a sub-motor mounted on the second base plate when the main motor is inoperable;

an inside emergency operation lever connected to an inside handle installed in the vehicle door, rotatable by an operational force of the inside handle, and configured to apply a torque to the catching part through the electric emergency door unlocking part;

an outside emergency operation lever connected to an outside handle installed in the vehicle door, rotatable by an operational force of the outside handle, and configured to apply a torque to the catching part through the electric emergency door unlocking part; and a manual emergency door unlocking part mounted on the second base plate, connected to the inside emergency operation lever, and configured to apply a torque to the catching part through the electric emergency door unlocking part by a torque of the inside emergency operation lever;

wherein the catching part comprises:

a catch rotatably mounted on the first base plate, and formed with a locking indentation configured to catch or release the striker;

a pawl rotatably mounted on the first base plate while contacting the catch, and configured to stop rotation of the catch or to enable the catch to freely rotate; and a pawl release lever disposed between the pawl and the first base plate and rotatable integrally with the pawl.

20. The vehicle of claim 19, wherein the door locking and unlocking part comprises:

the main motor mounted on the second base plate and including a main drive gear formed on a rotation shaft rotatable in both directions;

a main driven gear engaged with the main drive gear; and a main operation lever engaged with the main driven gear and configured to rotate the pawl release lever by being rotated by a torque from the main driven gear.

* * * * *